United States Patent [19]

Golub

[11] Patent Number: 4,510,360

[45] Date of Patent: Apr. 9, 1985

[54] CIRCUIT BREAKER WITH ARC SHIELD

[75] Inventor: Gregory J. Golub, Athens, Ga.

[73] Assignee: Westinghouse Electric Corp., Pittsburgh, Pa.

[21] Appl. No.: 502,373

[22] Filed: Jun. 8, 1983

[51] Int. Cl.[3] ..... H01H 9/30; H01H 33/04

[52] U.S. Cl. ..... 200/151; 200/11 B; 200/11 TC; 200/155 R

[58] Field of Search ..... 200/151, 11 B, 11 TC, 200/303, 155 R, 67 B, 67 PK, 67 A

[56] References Cited

U.S. PATENT DOCUMENTS

| | | | |
|---|---|---|---|
| 3,301,971 | 1/1967 | Johnson | 200/11 B |
| 3,715,543 | 2/1973 | Keto et al. | 200/151 |
| 4,412,116 | 10/1983 | Golub | 200/303 X |

*Primary Examiner*—J. R. Scott

*Attorney, Agent, or Firm*—L. P. Johns

[57] ABSTRACT

A circuit breaker with an arc shield characterized by a movable contact assembly which is rotatable between open and closed positions with respect to stationary contacts, and a cylindrical arc shield mounted on the assembly and rotatable therewith.

2 Claims, 3 Drawing Figures

CIRCUIT BREAKER WITH ARC SHIELD

CROSS-REFERENCE TO RELATED APPLICATION

This application is related to the copending, commonly assigned application of Gregory J. Golub, Ser. No. 382,251, filed May 26, 1982, now U.S. Pat. No. 4,412,116.

BACKGROUND OF THE INVENTION

1. Field of the Invention

This invention relates to a circuit breaker having a unitary actuating shaft with rotating movable contacts in alignment with stationary contacts, and an arc shield rotatable with the shaft and contacts thereon.

2. Description of the Prior Art

A switch of the "quick-make and quick-break" type is suitable for distribution transformers where the switch contacts are immersed in transformer oil. Such switches are disclosed in U.S. Pat. Nos. 3,461,259 and 3,590,183 and are provided with an overcenter spring mechanism for rotatably moving contact structures for opening and closing circuits. The rotatably movable contact structure comprises a contact carriage carrying pairs of contact fingers extending outwardly from the carriage, and making separable engagement with corresponding stationary spaced blade-type contacts.

A problem with this type of switch is that it is limited in its current interruption capabilities by the amount of arc quenching and insulating medium-transformer oil between the moving contacts and the stationary contacts in their open position. An obvious method for increasing the current interruption capacity would be to increase the physical size of the switch, thereby increasing the distance between the contacts. However, increased size requires increased inertia of the contact rotor, thus increasing the size of the operating mechanism.

SUMMARY OF THE INVENTION

It has been found in accordance with this invention this may be satisfied by providing a switch contact assembly comprising a housing member, first and second stationary contacts mounted on the housing, a longitudinal shaft extending through the housing and rotatable between open and closed circuit positions with respect to the first and second stationary contacts, a movable contact assembly with first and second interconnected movable contacts on the shaft and in the plane of the first and second stationary contacts for open and closed contact therewith, a cylindrical shielding member of dielectric material around the longitudinal shaft and having a hole facing each stationary contact, each movable contact extending through a corresponding hole so as to support the shielding member on the shaft, whereby the shielding member increases the distance between the contacts in their open position.

The advantage of the device of this invention is that it enables an increase in the current interruption capacity of a switch without increasing the physical size thereof.

DESCRIPTION OF THE PREFERRED EMBODIMENT

Figure 1:
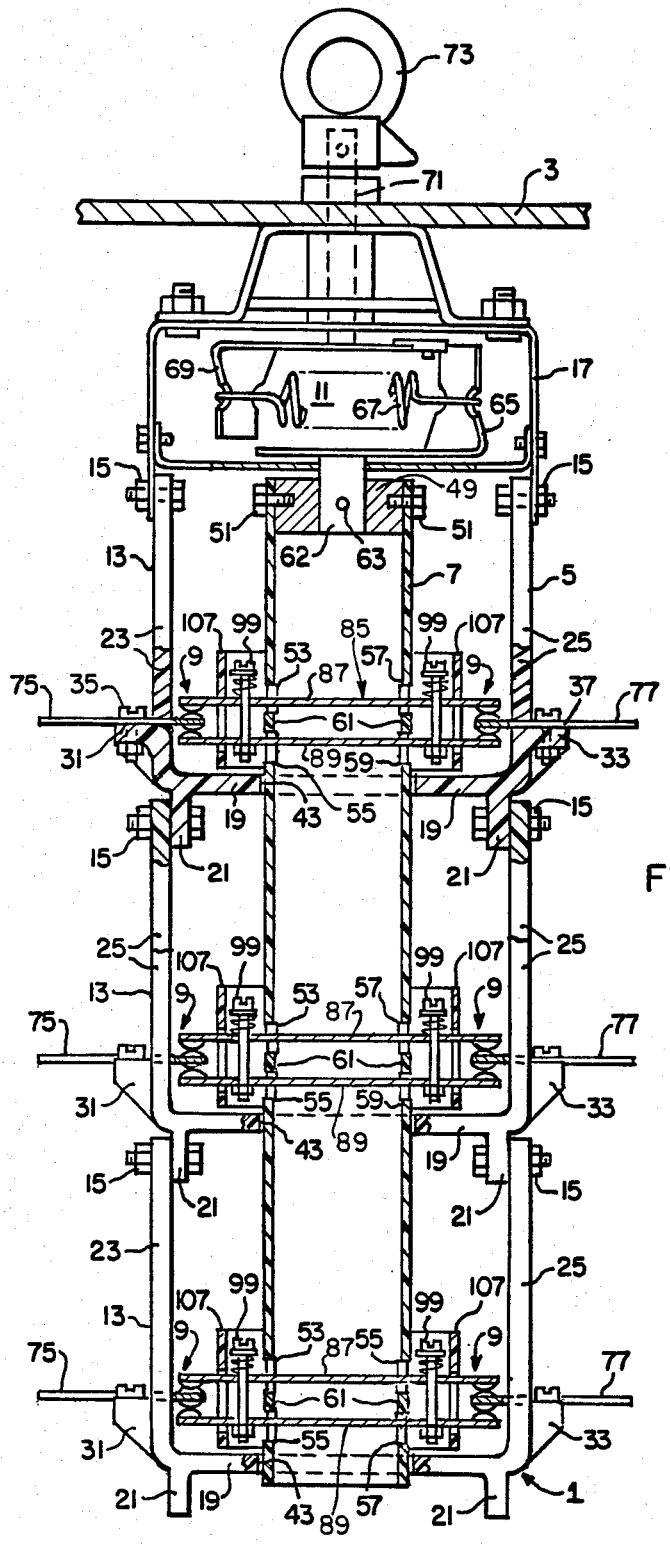
FIG. 1 is an elevational view, partly in section, of a circuit breaker of this invention.

A circuit breaker or switch is generally indicated at 1 (FIG. 1) and is typically used in conjunction with a pad-mounted or submersible-type transformer which provides underground distribution circuits for residential neighborhoods. A submersible-type transformer is generally disclosed in U.S. Pat. No. 3,461,259, issued Aug. 12, 1969, to M. G. Leonard et al., which comprises an underground vault in which a distribution transformer is located within a cylindrical housing. The transformer comprises a high voltage winding and a low voltage secondary winding which are inductively coupled. To provide a desired switching operation internally of the transformer tank, the switch 1 is mounted on an upper cover 3 of a transformer tank and it comprises an outer housing 5, a tubular shaft 7, a plurality of vertically spaced pairs of contacts generally indicated at 9, and an overcenter spring mechanism 11.

Although the switch is adapted for use with one or more phases, a three-phase switch is disclosed for purposes of illustration. Therefore, the housing 5 is comprised of three separable U-shaped supporting members or decks 13 of similar construction. Adjacent decks 13 are secured together by nut and bolt assemblies 15 and the uppermost deck is similarly secured to a box-like frame 17 in which the overcenter spring mechanism 11 is disposed. Each deck is a molded member comprised of an electrical dielectric material which includes a base 19 having a pair of spaced mounting flanges 21, and a pair of oppositely disposed upright sides 23, 25. An outturned flange 31, 33 is provided at the lower end of each side 23, 25, respectively, which flanges have top surfaces 35, 37, respectively, in planar alignment.

The base 19 includes a hole 43 through which the shaft 7 extends. Each hole 43 includes a pair of oppositely extending portions 45 (FIG. 3) to facilitate assembly, namely, insertion of the shaft with movable contacts mounted thereon.

The tubular shaft 7 (FIGS. 2, 3) is an elongated member comprised of dielectric material. The upper end of the shaft (FIG. 1) is secured to an end plug 49 by bolts 51. At vertically spaced intervals, pairs of openings 53, 55 are disposed along the inside of the shaft (FIGS. 1, 2) and in alignment with each other. Similar pairs of openings 57, 59 are disposed in diametrically opposite positions of the openings 53, 55, respectively. Each pair of openings 53, 55 and 57, 59 are separated by tube portions 61.

When assembled, the tubular shaft 7 (FIG. 1) is disposed centrally of the outer housing 5 and extends through aligned holes 43 which retain the shaft in alignment with a shaft 62 that is rigidly secured in the plug 49 by a pin 63. The upper end of the shaft 62 is secured to a spring arm 65 of the overcenter spring mechanism 11. A spring 67 extends between the arm 65 and a driving crank arm 69 that is secured to the lower end of an actuating shaft 71 which in turn is secured to an eyelet operating handle 73. Rotation of the handle 73 between two positions moves the spring 67 overcenter of the shaft 63 in a conventional manner, thereby rotating the tubular shaft 7 between open and closed positions of the switch contacts in a quick-make and quick-break loadbreak manner to avoid welding of the movable and stationary contacts.

Figure 3:
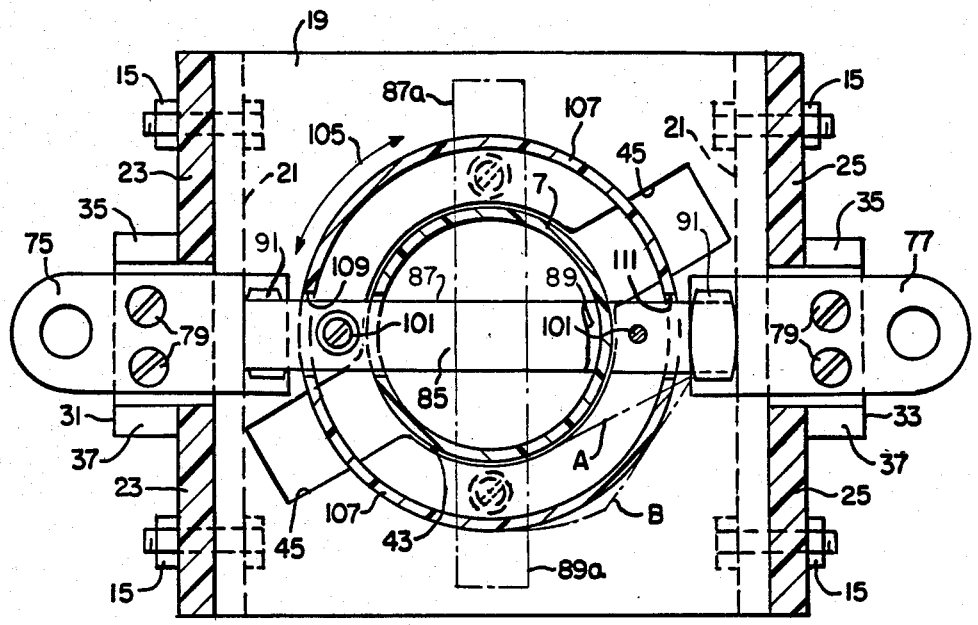
FIG. 3 is a horizontal sectional view taken on the line III—III of FIG. 2.
Figure 2:
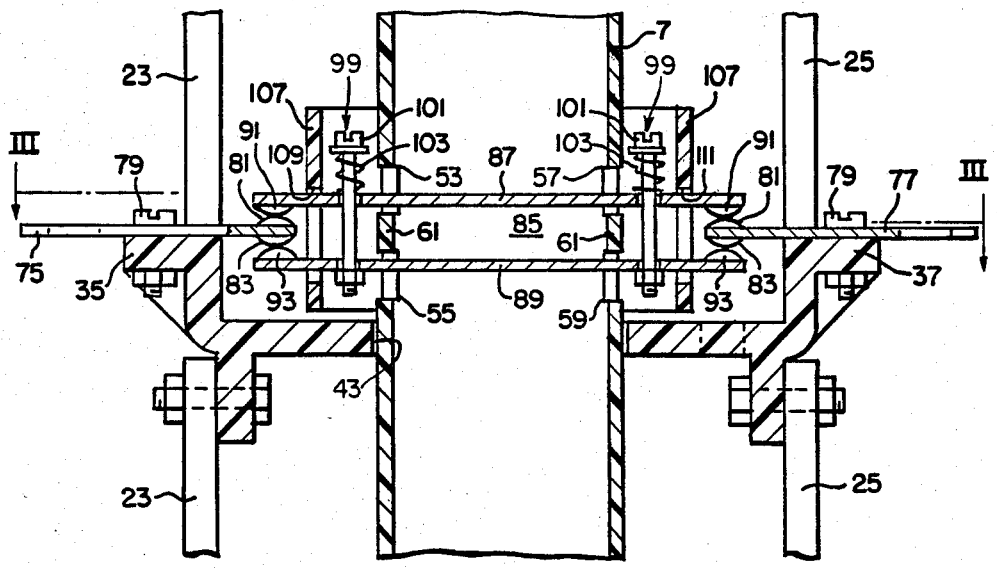
FIG. 2 is a fragmentary vertical sectional view showing one switch unit in the closed position.

The phase structure of any phase shown in FIG. 1 includes a pair of spaced stationary contact blades 75, 77 (FIGS. 2, 3). The blades 75, 77 are in planar alignment and mounted on aligned planes 35, 37 whereby they are secured in place by similar bolts 79. The inner end of each blade 75, 77 includes similar upper contact 81 and lower contact 83.

A rotatable contact carrier 85 is disposed between stationary contact blades 75, 77 for making and breaking the circuit therebetween. The carrier 85 comprises a pair of contact carrying bridges 87, 89, on which similar contacts 91, 93 are mounted for engagement with stationary contacts 81, 83 (FIG. 2). The contact carrier 85 comprises a pair of clamping devices 99 to provide contact pressure during normal operating conditions. Each clamping device 99 comprises a nut and bolt unit 101 as well as a spring 103.

The circuit path from the stationary blade 75 extends through the stationary contacts 81, 83, the movable contacts 91, 93, the bridges 87, 89, the movable contacts 91, 93, the stationary contacts 81, 83 to the stationary blade 77. Under normal operating conditions the pressure applied by the clamping devices 99 is sufficient to maintain satisfactory contact between the movable and stationary contacts. In this manner any damage to the contact such as by welding is avoided.

As indicated above the contacts are shown in the closed circuit position in the several views of the drawings. In the open circuit position the bridges 87, 89 are shown in the broken line positions (FIG. 3) and are movable between open and closed positions as indicated by an arrow 105.

In accordance with this invention, a dielectric shielding member or arc shield 107 is provided to facilitate arc quenching primarily during the opening of the circuit during rotation of the shaft 7 and movement of the bridges 87, 89 to the broken line positions **87*a* 89*a* (FIG. 3). The arc shield 107 is a cylindrical, hollow member which surrounds the shaft 7. The arc shield 107 is composed of sufficient dielectric material having arc resistant properties, such as a filament wound glass epoxy tubing, rag paper, or molded thermoplastic/thermosetting polyester. The arc shield 107 is fitted around the shaft and is keyed to the moving contacts 91, 93. For that purpose, the arc shield 107 includes oppositely disposed holes 109, 111 through which the bridges 87, 89 extend. In this manner, the arc shield 107 is supported in place and rotates with the carrier 85** between open and closed contact positions.

It is noted that the arc shield 107 conceals that part of the moving contact assembly or carrier 85 which is closest to the stationary contacts 81, 83. In other words, the arc shield 107 (FIG. 3) provides a greater amount of arc quenching and insulating material (transformer oil) between the load interrupting contacts during load interruption. This fact is evident by comparing dimension A to the longer dimension B, which dimensions extend between the stationary contacts 91, 93 and the bridges 87, 89 in the closed and open positions. More particularly, the dimension A is the distance between arcing members without the arc shield 107. Dimension B is the distance between the arcing members with the arc shield 107 in place. Accordingly, during interruption of current, more arc quenching and insulating material such as transformer oil exists between the arc interrupting contacts. The result is that the switch can interrupt increased currents.

In conclusion, the arc shield of this invention provides an increased interruption capacity without increasing the physical size of the switch and with nominal cost.

What is claimed is:

1. An electrical switching contact assembly comprising:

(a) a housing member having a base plate with a circular opening;

(b) first and second stationary contacts;

(c) means disposed on the base plate for mounting the first and second stationary contacts symmetrically about the circular opening and in a plane substantially perpendicular to the longitudinal axis of the circular opening;

(d) a longitudinal shaft extending into the circular opening;

(e) external means connected to the shaft for rotating the shaft between open and closed circuit positions;

(f) a movable contact assembly on the shaft and including a pair of parallel conductors having first and second end portions, the end portions of the first pair of conductors being engagable with opposite sides of the first stationary contact and the end portions of the second pair of conductors being engagable with opposite sides of the second stationary contact;

(g) spring clamping means on each pair of end portions for holding the end portion in clamping engagement with the corresponding stationary contacts;

(h) a cylindrical shielding member of electrically insulating material surrounding the shaft and the spring clamping means; and (i) mounting means for mounting the shielding member and including holes through which the end portions extend and support the member in place whereby the shielding member increases the dielectric strength between the contacts in the open position.

2. The assembly of claim 1 in which the first and second contacts are located on opposite sides of the shaft.

* * * * *